United States Patent [19]

Berntell

[11] Patent Number: 4,612,769

[45] Date of Patent: Sep. 23, 1986

[54] POWER CONTROL SYSTEM FOR A HOT GAS ENGINE

[75] Inventor: John O. Berntell, Staffanstorp, Sweden

[73] Assignee: Mechanical Technology Incorporated, Latham, N.Y.

[21] Appl. No.: 806,451

[22] Filed: Dec. 9, 1985

[30] Foreign Application Priority Data

Aug. 6, 1985 [SE] Sweden ..... 8503716

[51] Int. Cl.[4] ..... F02G 1/06

[52] U.S. Cl. ..... 60/521; 60/517

[58] Field of Search ..... 60/517, 521, 522, 525

[56] References Cited

U.S. PATENT DOCUMENTS 4,030,297 6/1977 Kantz et al. ..... 60/521

4,485,627 12/1984 Almström ..... 60/521 X

FOREIGN PATENT DOCUMENTS 1383860 2/1975 United Kingdom .

*Primary Examiner*—Stephen F. Husar

*Attorney, Agent, or Firm*—Joseph V. Claeys

[57] ABSTRACT

A power control system for a hot gas engine of the type in which the power output is controlled by varying the mean pressure of the working gas charge in the engine has according to the present invention been provided with two working gas reservoirs at substantially different pressure levels. At working gas pressures below the lower of said levels the high pressure gas reservoir is cut out from the control system, and at higher pressures the low pressure gas reservoir is cut out from the system, thereby enabling a single one-stage compressor to handle gas within a wide pressure range at a low compression ratio.

12 Claims, 2 Drawing Figures

POWER CONTROL SYSTEM FOR A HOT GAS ENGINE

The Government of the United States of America has rights in this invention pursuant to Contract DEN3-32 awarded by the U.S. Department of Energy.

BACKGROUND OF THE INVENTION

1. Field of the Invention

The present invention relates to a power control system for a hot gas engine of the type in which the power output is controlled by varying the mean pressure of the working gas charge in the engine.

2. Description of the Prior Art

Power control systems for hot gas engines of the type referred to above will normally comprise a high pressure working gas reservoir a gas duct containing two series connected valves interconnecting said reservoir and the working gas chambers of a hot gas engine to be controlled and a gas compressor the suction side of which is connected to the working gas chambers of the engine via a duct containing a non-return valve and an on-off valve connected in series, the delivery side of said gas compressor being connected to said reservoir through a duct containing a non-return valve.

The British Patent Specification No. 1 383 860 shows an example of such known power control system.

However, in case of hot gas engines used for automobiles the maximum power output of the engine is many times greater than the minimum engine power consumption at idling. Therefore, the maximum working gas pressure is several times greater than the minimum working gas pressure. At idling and at low engine power outputs when the mean working gas pressure is low the compressor will have to operate under severe conditions—i.e. a great pressure difference between its suction and delivery side. It will generally be necessary to use a two-stage compressor if the compression ratio is greater than 8.

SUMMARY OF THE INVENTION

The present invention has for its object to provide a power control system in which a wide operating range may be obtained using a compressor with a small compression ratio—less than 4—and thus making it possible to use a simple one-stage compressor.

To achieve this object and in accordance with the present invention the system also comprises a low pressure working gas reservoir provided with a valve governed connection which is branched off from said connection between the delivery side of the compressor and the high pressure gas reservoir, the said valve governed connection to the low pressure gas reservoir also being branched off from said connection between said high pressure gas reservoir and the working gas chambers of the engine at a location between the said two series connected valves, the branch connection containing a check valve allowing flow of gas only in the direction from said low pressure gas reservoir into the working gas chambers of the engine.

The accompanying drawings illustrate an example of the prior art as well as an example of an embodiment of the present invention.

DETAILED DESCRIPTION OF THE DRAWINGS

Figure 1:
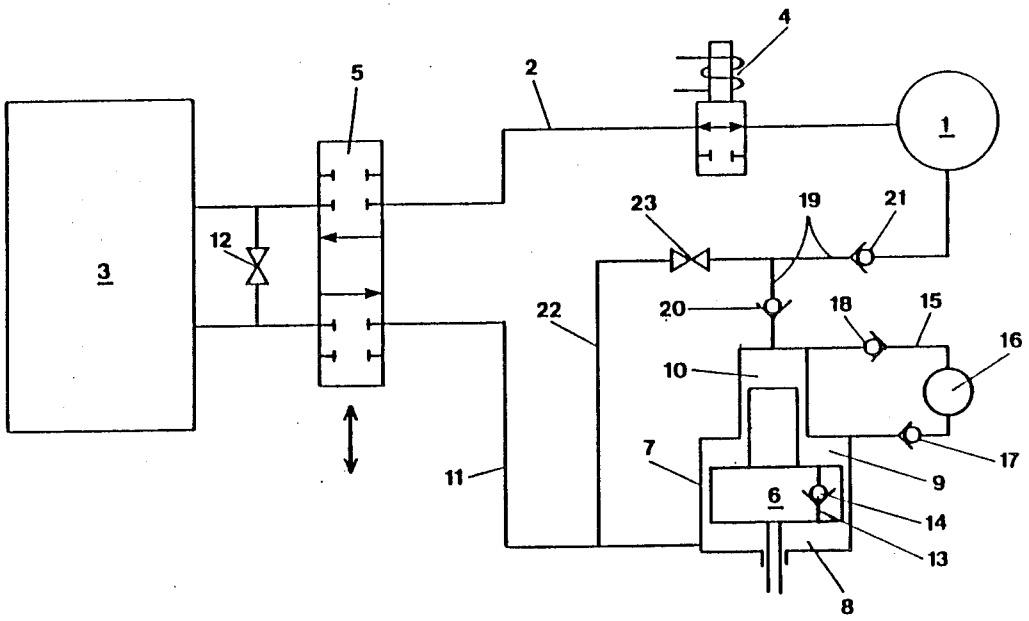
(Prior Art) Fig. 1
FIG. 1 shows schematically a power control system of know type.

The prior art power control system shown in FIG. 1 comprises a high pressure working gas reservoir 1 containing 4 liters of hydrogen at a pressure of 22.5 MPa. A gas duct 2 connects said reservoir 1 with the working gas chambers (not shown) of a hot gas engine 3. The duct 2 contains an on-off solenoid valve 4 and a three-piston valve 5—one position of which allows connection between the reservoir 1 and the engine 3 while the remaining two positions prevent such connection. A two-stage compressor 6, 7 is illustrated as a stepped piston 6 slidably mounted in a stepped cylinder 7. The compressor 6, 7 has three working chambers 8, 9 and 10 a lower working chamber 8 a middle chamber 9 and an upper working chamber 10. The lower chamber 8 is connected to the working chambers (not shown) of the engine 3 via a conduit 11. The conduit 11 is governed by the three position valve 5 having two positions blocking the conduit 11 and one allowing gas passage through said conduit.

A short-circuiting valve 12 is arranged to make it possible to obtain a direct connection between the duct 2 and the conduit 11 near the engine 3. The piston 6 has a connection 13 including a non-return valve 14 allowing flow of gas only in the direction from the chamber 8 to the chamber 9 of the compressor 6, 7. The chambers 9 and 10 are connected by a conduit 15 having a receiver 16 and two non-return valves 17 and 18 allowing flow of gas only in the direction from the chamber 9 to the chamber 10. The chamber 10 is connected to the reservoir 1 via a conduit 19 containing two non-return valves 20 and 21 allowing flow of gas only in the direction towards the reservoir 1.

A conduit 22 containing an on-off valve 23 interconnects the conduits 11 and 19.

The known power control system described above and shown in FIG. 1 will operate as follows:

In the position shown in FIG. 1 the solenoid valve 4 is in its open position and so is the valve 23. The valve 12 is closed and the three-position valve 5 is in its middle position in which the duct 2 and the conduit 10 are blocked.

The engine 3 may now be running at a power output corresponding to the prevailing mean pressure of the working gas in its working gas chambers.

If it is desired to increase the power output of the engine 3 the three-position valve 5 is moved into its upper position in which flow through the duct 2 is allowed, but in which flow through the conduit 11 is still prevented.

Gas may now pass from the reservoir 1 into the working gas chambers of the engine 3 and increase the mean working gas pressure of the engine 3 and thus the power output of the engine. As soon as the power output has reached the desired level, the valve 5 is returned to the position shown in FIG. 1 and the gas supply into the engine will cease.

If it is desired to decrease the power output of the engine, the three-position valve 5 is moved into its lower position in which supply of gas through the duct 2 is still prevented, but in which gas may leave the engine via the conduit 11. The valve 23 is simultaneously closed and gas will now be pumped by the compressor 6, 7 from the conduit 11 to the chamber 8 and via the conduit 13 to the chamber 9, via the conduit 15, the receiver 16 to the chamber 10 and via the conduit 19 to the receiver 1. The object of the conduit 22 and the valve 23 is to relieve the compressor from compression work when pumping is not desired. For practical reasons the compressor 6, 7 may be continuously activated by the engine 3—e.g. by direct connection to the engine crank shaft. The object of the valve 12 is to interconnect all working chambers (not shown) of the engine and thus obtain a very fast decrease in power output.

In a hot gas engine for automotive use the idling working gas pressure may be as low as 2.5 MPa whereas the mean working gas pressure at maximum power output may be 22.5 MPa.

Figure 2:
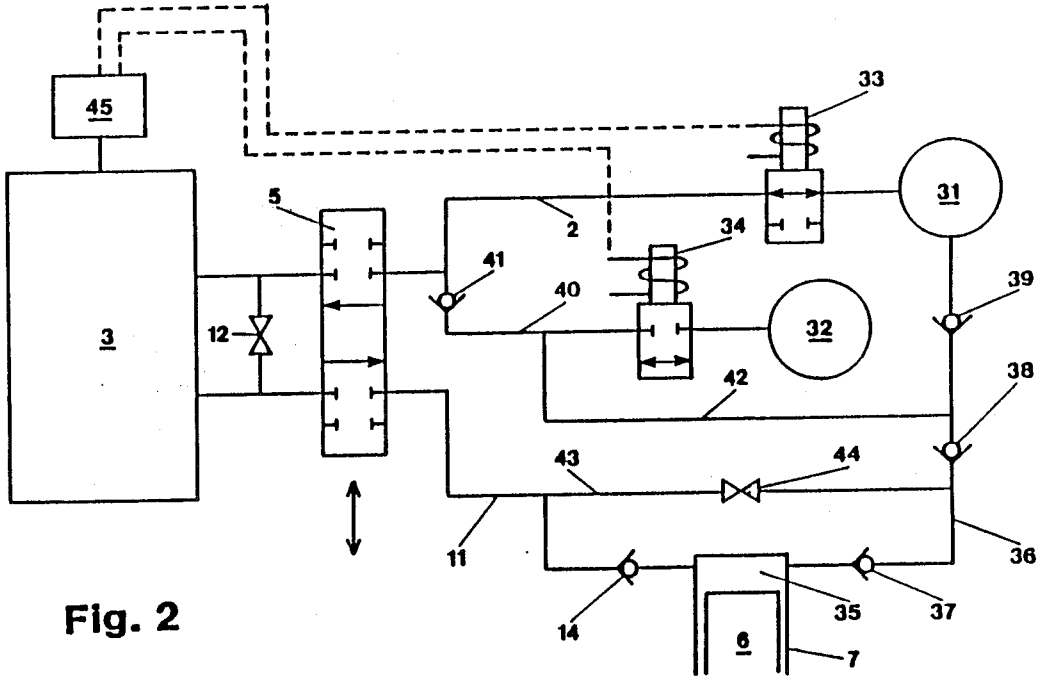
FIG. 2 shows schematically a power control system according to the present invention.

A compressor having a compression ratio of more than 1:8 should normally be designed as a two-stage compressor as shown in FIG. 1. FIG. 2 shows an embodiment of a power control system according to the present invention.

As in the known system of FIG. 1 the hot gas engine has been designated by 3, the supply duct by 2, the pressure decrease conduit by 11, a three-position valve by 5 and a short-circuit valve by 12. The compressor 6, 7 is designed as a one-stage compressor and the conduit 11 leading gas to the compressor 6, 7 contains a non-return valve 14.

However, the system shown in FIG. 2 comprises two working gas reservoirs 31 and 32 the outlets of which are governed by solenoid valves 33 and 34 respectively. The reservoir 31 contains hydrogen of 22.5 MPa and is connected to the engine 3 via the duct 2 containing the three-position valve 5. The compressor 6, 7 has a single working chamber 35 the delivery side of which is connected the reservoir 31 via a duct 36 containing three non-return valves 37, 38 and 39.

The gas reservoir 32 is a low pressure working gas reservoir containing hydrogen at 7.5 MPa. It is connected to the duct 2 by a conduit 40 containing said solenoid valve 34 and a non-return valve 41. Between the non-return valve 41 and the solenoid valve 34 the conduit 40 is connected to the conduit 36 between the valves 38 and 39. Said connection has been designated by 42.

The suction side and the delivery side of the compressor 6, 7 are interconnected by a conduit 43 containing a valve 44.

The engine 3 is provided with a pressure operated switch 45 adapted to keep the solenoid valve 33 open and the valve 34 closed in case the working gas mean pressure is above 7.5 MPa. The switch 45 will also keep the valve 33 closed and the valve 34 open in case the working gas mean pressure is below 7.5 MPa.

The system described above and shown in FIG. 2, will operate as follows:

Assuming that the engine 3 is running at a constant, rather high power output—e.g. corresponding to a mean working gas pressure of 15 MPa and that no change in power output is desired the valves 5, 33 and 34 are in their positions shown in FIG. 2. The valve 12 is closed and the valve 44 is open. The compressor 6, 7 is running continuously, but is idling as there is a direct connection between the suction side and the delivery side of the compressor via the conduit 43.

In case the power output should be increased the valve 5 is moved from its middle position (shown) to its upper position in which the duct 2 is opened while the conduit 11 remains closed. High pressure gas may now flow from the reservoir 31 into the working gas chambers of the engine 3 and increase the mean gas pressure and thus the power output. As soon as the power output has reached its desired level, the valve 5 is moved back into the position shown in FIG. 2.

In case the power output should be decreased the valve 5 is moved into its lower position in which the conduit 11 is opened while the duct 2 remains closed. Simultaneously the valve 44 is closed. The compressor 6, 7 will now suck gas from the working gas chambers of the engine into the high pressure working gas reservoir 31 via the conduits 11 and 36. As soon as the mean gas pressure in the engine 3 has been lowered so much that the desired power output has been obtained, the valve 5 is returned into the position shown in FIG. 2 in which the duct 2 and the conduit 11 are closed. The valve 44 is opened simultaneously.

In case it is desired to decrease the power output almost instantly the valve 12 is opened. Opening of the valve 12 will cause a short-circuiting of the working gas chambers (not shown) of the engine.

In case the engine 3 is running at a constant low load—corresponding to a mean working gas pressure of e.g. 5 MPa—the valve 33 will be in its closed position and the valve 34 in its open position.

If it is desired to increase the power output of the engine the valve 5 is moved into its upper position in which the duct 2 is opened while the conduit 11 remains closed. Gas may now flow from the low pressure working gas resevoir 32 via the conduit 40 and the duct 2 into the working gas chambers of the engine. As soon as sufficient gas has been supplied the valve 5 is returned to the middle position shown.

If the power output should be decreased, the valve 5 is moved into its lower position in which the duct 2 remains closed while the conduit 11 is opened. The valve 44 is now closed and the compressor may suck gas from the engine working gas chambers via the conduit 11 and deliver it via the conduits 36 and 42 to the low pressure working gas reservoir 32. As soon as the desired—lower—power output level is obtained the valve 5 is returned to the position shown and the valve 44 is opened.

In case of need for a very rapid power decrease the valve 12 may be opened.

Rapid power decreases are quite normal during running of an automobile engine. Therefore, opening of the valve 12 will occur at any prevailing power output. However, during periods when the valve 12 is open great power losses will occur. Therefore, the periods during which the valve 12 is kept open should be as small as possible. This can only be done by increasing the capacity of the compressor 6, 7. According to the present invention the capacity of the compressor is increased by decreasing the compressor work. The compression ratio may be lower than 1:3 due to the fact that the gas reservoirs are at different pressure levels. A one-stage compressor is also cheaper and simpler to maintain.

I claim:

1. A power control system for a hot gas engine of the type in which the power output is controlled by varying the mean pressure of the working gas charge in the engine, said system comprising a high pressure working gas reservoir, a gas duct containing two series connected valves interconnecting said reservoir and the working gas chambers of a hot gas engine to be controlled, and a gas compressor the suction side of which is connected to the working gas chambers of the engine via a duct containing a non-return valve and an on-off valve connected in series, the delivery side of said gas compressor being connected to said reservoir through a duct containing a non-return valve, characterized in that the system also comprises a low pressure working gas reservoir provided with a valve governed connection, and a branch connection one end of which is branched off from said connection between the delivery side of the compressor and the high pressure gas reservoir, the said valve-governed connection to the low pressure gas reservoir also being branched off from said gas duct between said high-pressure gas reservoir and the working gas chambers of the engine at a location between the said two series connected valves, the branch connection containing a check valve allowing flow of gas only in the direction from said low pressure gas reservoir into the working gas chambers of the engine.

2. A power control system as in claim 1 wherein said gas compressor is a single-stage compressor.

3. A power control system as in claim 2 wherein said compressor has a compression ratio of 1:3 or less.

4. In a power control system for a hot gas engine of the type in which the power output is controlled by varying the mean pressure of the working gas charge in the engine, said system comprising a high-pressure working gas reservoir, a gas duct including valve means for interconnecting said high-pressure reservoir and the working chambers of a hot gas engine to be controlled, and a gas compressor having a suction side and a pressure side, the suction side being connected to the working gas chambers of the engine by a duct including a non-return valve and an on-off valve connected in series, and the pressure side of the compressor being connected to the high-pressure reservoir by a duct containing at least one non-return valve, the improvement in which said gas compressor is a single stage gas compressor, and said power control system also includes a low-pressure working gas reservoir having a duct including an on-off valve and coupled to said valve means to interconnect the low pressure reservoir with the engine working chambers, the last-mentioned duct also being coupled to the pressure side of the compressor to receive the working gas from said compressor for storage in said low-pressure reservoir.

5. The power control system of claim 4 wherein said last-mentioned duct includes a non-return valve for flow only in the direction from the compressor to said low-pressure reservoir.

6. The power control system of claim 4 wherein said low-pressure reservoir has a predetermined pressure capacity and said high-pressure reservoir has a higher predetermined pressure capacity.

7. The power control system of claim 6 wherein said low-pressure reservoir capacity is on the order of one-third the high-pressure reservoir capacity.

8. The power control system of claim 6 wherein said on-off valves associated with said high-pressure and low-pressure reservoirs are solenoid controlled valves, and said system further comprises pressure-operated switch means for opening the high-pressure reservoir on-off valve when the engine working gas mean pressure exceeds the predetermined pressure capacity of the low-pressure reservoir, and for closing the high-pressure reservoir on-off valve when the engine working gas mean pressure falls below the pressure capacity of the low-pressure reservoir.

9. A power control system for a hot gas engine of the type in which the power output is controlled by varying the mean pressure of the working gas charge in the engine, said system comprising a high pressure working gas reservoir, a first gas duct containing two series connected valves and interconnecting said reservoir and the working gas chambers of a hot gas engine to be controlled and a gas compressor, the suction side of which is connected to the working gas chambers of the engine via a second gas duct containing a non-return valve and an on-off valve connected in series, the delivery side of said gas compressor being connected to said reservoir through a third gas duct containing a non-return valve, characterized in that the system also comprises a low pressure working gas reservoir provided with a valve governed connection having a branch flow-connected to said third gas duct, the said valve governed connection to the low pressure gas reservoir also being flow-connected to said first gas duct at a location between the said two series connected valves, the valve governed connection containing a check valve prohibiting flow of gas only in the direction from said first gas duct into said low pressure gas reservoir.

10. The power control system as in claim 9, wherein said check valve is located in said valve governed connection between said branch and said first gas duct location.

11. The power control system as in claim 9, wherein said non-return valve is positioned between said high pressure gas reservoir and the point where said branch flow-connects to said third gas duct, and wherein the power control system further includes a second non-return valve positioned between said point and the delivery side of the compressor.

12. The power control system as in claim 9, wherein the upstream one of said series connected valves is a first solenoid valve and wherein said valve governed connection is governed by a second solenoid valve, the power control system further including a switch responsive to the pressure in the working gas chambers and electrically interconnected with said first and said second solenoid valves, said switch maintaining said first solenoid valve open and the second solenoid valve closed above a predetermined working gas pressure, and maintaining said first solenoid valve closed and said second solenoid valve open below said predetermined pressure.

* * * * *